US009549619B2

(12) United States Patent
Hashiba

(10) Patent No.: US 9,549,619 B2
(45) Date of Patent: Jan. 24, 2017

(54) CUSHION FOR CO-SLEEPING

(71) Applicant: Yoshimichi Hashiba, Toyohasi (JP)

(72) Inventor: Yoshimichi Hashiba, Toyohasi (JP)

( * ) Notice: Subject to any disclaimer, the term of this patent is extended or adjusted under 35 U.S.C. 154(b) by 0 days.

(21) Appl. No.: 14/986,665

(22) Filed: Jan. 2, 2016

(65) Prior Publication Data

US 2016/0135608 A1 May 19, 2016

Related U.S. Application Data

(63) Continuation of application No. PCT/JP2013/068983, filed on Jul. 11, 2013.

(30) Foreign Application Priority Data

Jul. 3, 2013 (JP) ..... 2013-003805

(51) Int. Cl.

| | |
|---|---|
| ***A47C 21/00*** | (2006.01) |
| ***A47C 21/08*** | (2006.01) |
| ***A47G 9/10*** | (2006.01) |
| ***A47D 15/00*** | (2006.01) |
| ***A61G 7/05*** | (2006.01) |
| ***A47C 20/02*** | (2006.01) |
| ***A47D 7/04*** | (2006.01) |
| *A61G 7/065* | (2006.01) |

(52) U.S. Cl.

CPC ..... *A47C 21/08* (2013.01); *A47C 20/02* (2013.01); *A47D 7/04* (2013.01); *A47D 15/008* (2013.01); *A47G 9/10* (2013.01); *A47G 9/1009* (2013.01); *A61G 7/0525* (2013.01); *A61G 7/065* (2013.01)

(58) Field of Classification Search

CPC ..... A47C 21/00
USPC ..... 5/425–430, 630, 632, 640, 657, 659
See application file for complete search history.

(56) References Cited

U.S. PATENT DOCUMENTS 5,463,781 A * 11/1995 Jones ..... A61G 7/05723 297/217.1
6,467,830 B1 10/2002 Fox et al.
(Continued)

FOREIGN PATENT DOCUMENTS

JP 3079794 6/2001
JP 2002-253622 9/2002
(Continued)

OTHER PUBLICATIONS

International Search Report in corresponding International Application PCT/JP20131068983, WIPO, Aug. 23, 2013.

*Primary Examiner* — Fredrick Conley
(74) *Attorney, Agent, or Firm* — Ryan Alley IP

(57) ABSTRACT

Flexible cushions include structures configured to secure to a mattress or other sleeping surface, permitting cushion re-shaping to divide or otherwise configure a sleeping space. Cushions join to the mattress via an L-shaped plate that seats against a side an under a bottom of the mattress. The cushion is supported by the L-shaped plate, which may extend inside the cushion or otherwise mate with a flexible shaping pipe in the cushion. The flexible pipe in the cushion allows the cushion to be shaped in any fashion with sufficient human force while retaining its shape when slept on. The L-shaped plate is joined to an opposite latch plate that secures to an opposite side of the mattress by an adjustable belt that runs between the L-shaped plate and latch plate. The belt may run under the mattress and join to any number of structures.

8 Claims, 16 Drawing Sheets

(56) References Cited

U.S. PATENT DOCUMENTS

| | | | | |
|---|---|---|---|---|
| 6,499,801 | B1 | 12/2002 | Peterson et al. | |
| 6,658,681 | B2 * | 12/2003 | Britto | A47D 13/083 5/636 |
| 6,990,697 | B1 * | 1/2006 | Clute | A47C 21/08 5/425 |
| 7,082,634 | B1 | 8/2006 | Hinds | |
| 2004/0255387 | A1 | 12/2004 | England | |
| 2011/0271451 | A1 | 11/2011 | Huttner et al. | |

FOREIGN PATENT DOCUMENTS

| | | |
|---|---|---|
| JP | 2003-062018 | 3/2003 |
| JP | 3101244 | 6/2004 |
| JP | 3126368 | 4/2006 |
| JP | 20131068983 | 8/2015 |

* cited by examiner

CUSHION FOR CO-SLEEPING

RELATED APPLICATIONS

This application claims priority under 35 U.S.C. §120 to, and is a continuation of, co-pending International Application PCT/JP2013/068983, filed Jul. 11, 2013 and designating the U.S., which claims priority to Japanese Application 2013-003805 filed Jul. 3, 2013. These Japanese and International Applications are incorporated by reference herein in its entirety.

BACKGROUND

Co-sleeping is recognized as an important physical contact that allows an infant to psychologically grow. The co-sleeping that allows such an effect is typically conducted by putting a baby in the bed of a co-sleeper or neighbor to a co-sleeper. Further, the co-sleeping may be conducted by placing a bed of the co-sleeper neighbor to a baby-bed so that the co-sleeper tips the bar that surrounds the baby bed neighbor to the bed of the co-sleeper so as to lean out of the bed to comfort the baby. Further, a co-sleeping method may be conducted by placing a so-called co-sleeping bed that is surrounded by three sides except the side of the foot on the bed so that adults let the baby sleep inside the bed for adults.

For example, Japanese Utility model Publication No. 3126368 published Apr. 10, 2006, incorporated herein in its entirety, discloses a cushion used at the abdomen or back of the mother for breast-feeding during co-sleeping for the baby, and Japanese Utility model Publication No. 3079794 published Jun. 13, 2001, incorporated herein in its entirety, discloses a mat used for arm pillow during co-sleeping with a baby. The side of the mat for a head of the baby leans upward while a concave portion is provided in which an arm is placed for arm pillow.

SUMMARY

Example embodiments include specially-shaped cushions for co-sleeping among several laying humans. Example embodiment cushions include a latch plate coupled with a belt and L-shaped plate. A cushion including a bendable pipe or other shape-retaining structure is supported on the L-shaped plate, allowing the cushion to be fashioned into any desired shape on the L-shaped plate. Several of the L-shaped plates may be used in connection with a single cushion, and the belt may be adjustable to accommodate several plates and various cushion shapes.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION

Figure 1:
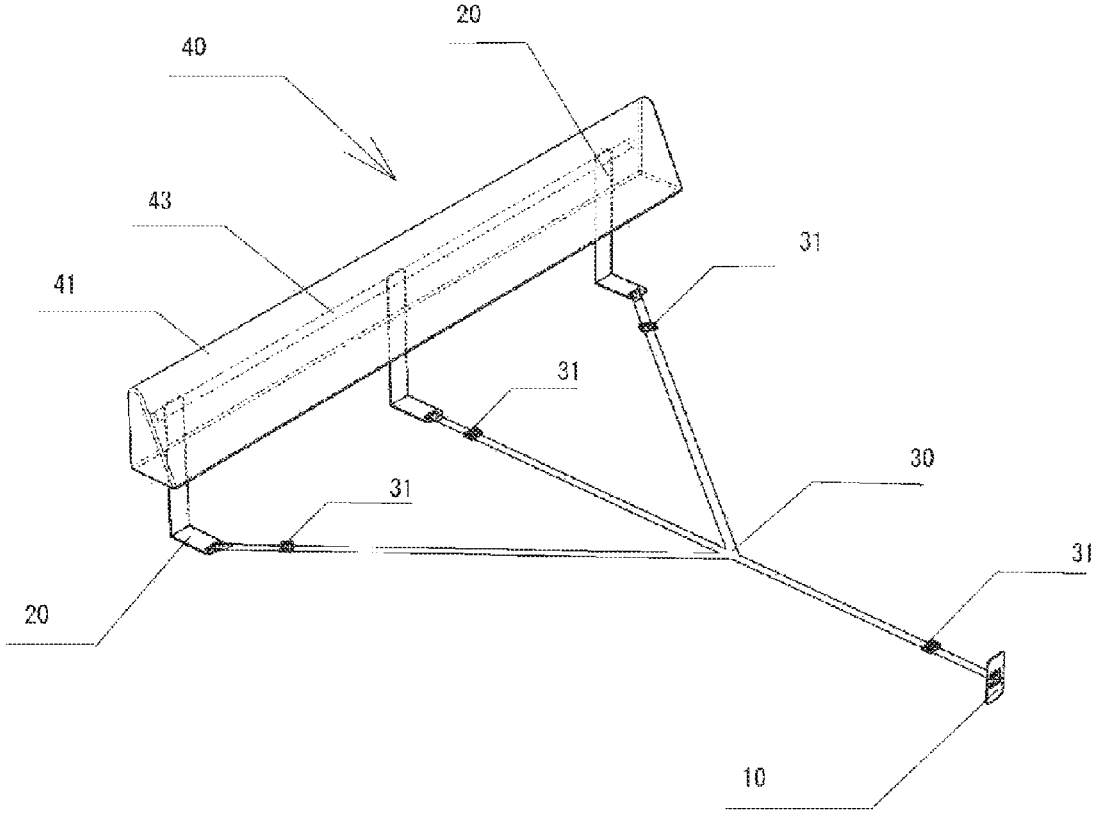
FIG. 1 is a perspective view of the cushion for co-sleeping according to an example embodiment.

This is a patent document, and general broad rules of construction should be applied when reading it. Everything described and shown in this document is an example of subject matter falling within the scope of the claims, appended below. Any specific structural and functional details disclosed herein are merely for purposes of describing how to make and use example embodiments. Several different embodiments not specifically disclosed herein may fall within the claim scope; as such, the claims may be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when element(s) are referred to in relation to one another, such as being "connected," "coupled," "mated," "attached," or "fixed" to another element(s), the relationship can be direct or with other intervening elements. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). Similarly, a term such as "connected" for communications purposes includes all variations of information exchange routes between two devices, including intermediary devices, networks, etc., connected wirelessly or not.

As used herein, the singular forms "a", "an," and "the" are intended to include both the singular and plural forms, unless the language explicitly indicates otherwise with terms like "only a single element." It will be further understood that the terms "comprises," "comprising," "includes," and/or "including," when used herein, specify the presence of stated features, values, steps, operations, elements, and/or components, but do not themselves preclude the presence or addition of one or more other features, values, steps, operations, elements, components, and/or groups thereof.

It should also be noted that the structures and operations discussed below may occur out of the order described and/or noted in the figures. For example, two operations and/or figures shown in succession may in fact be executed concurrently or may be executed in the reverse order, depending upon the functionality/acts involved. Similarly, individual operations within example methods described below may be executed repetitively, individually or sequentially, so as to provide looping or other series of operations. It should be presumed that any embodiment having features and functionality described below, in any workable combination, falls within the scope of example embodiments.

The inventors have recognized that existing systems of co-sleeping carry a risk of crushing death or choking death due to rolling over during co-sleeping. For fear of such a risk, a co-sleeper may be unable to sleep or to sleep for a sufficient time. During co-sleeping on a bed, a baby may roll over and fall from the bed. Placing a baby-bed next to or in the bed of the co-sleeper may requires a large room, and may present an uneven sleeping surface and thus the co-sleeper may uncomfortably feel or lay on the uneven surface. Such a co-sleeping bed generally cannot be used for purposes other than co-sleeping. Example embodiments described below uniquely solve these and other newly-recognized problems by providing a co-sleeping cushion that prevents accidents of crushing death or choking death during co-sleeping, is capable of being used for preventing babies from fallout, and/or is also capable of being used for assistance for sitting up as well as securing safety during co-sleeping.

The present invention is a supported cushion that permits safe and configurable co-sleeping among several humans. In contrast to the present invention, the few example embodiments and example methods discussed below illustrate just a subset of the variety of different configurations that can be used as and/or in connection with the present invention.

FIG. 1 is a perspective view of an example embodiment cushion for co-sleeping. A planar latch plate 10 is coupled with an L-shape plate 20 via a belt member 30. This L-shape plate 20 supports a cushion member 40.

Figure 5:
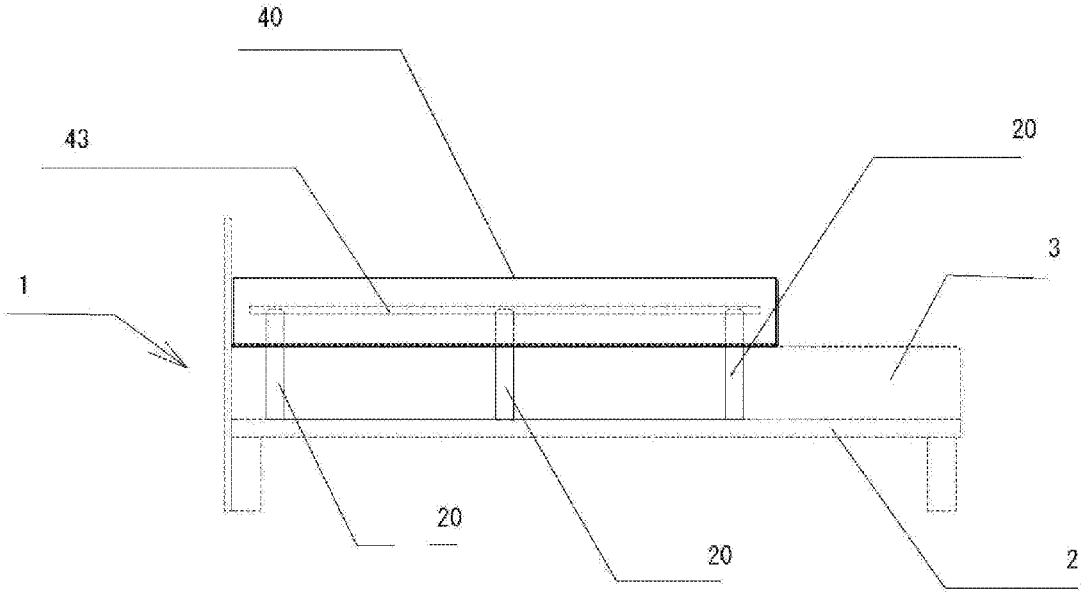
FIG. 5 is an elevation view indicating usage state of an example embodiment cushion for co-sleeping.
Figure 6:
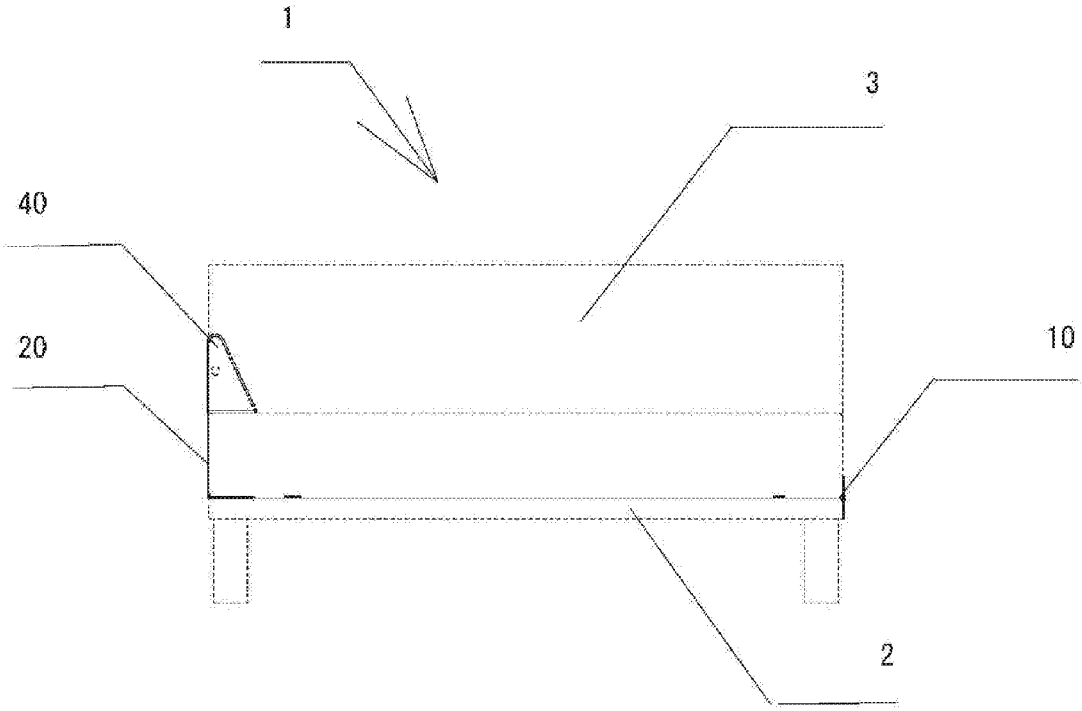
FIG. 6 is a right side view of the of an example embodiment cushion for co-sleeping of FIG. 5.
Figure 7:
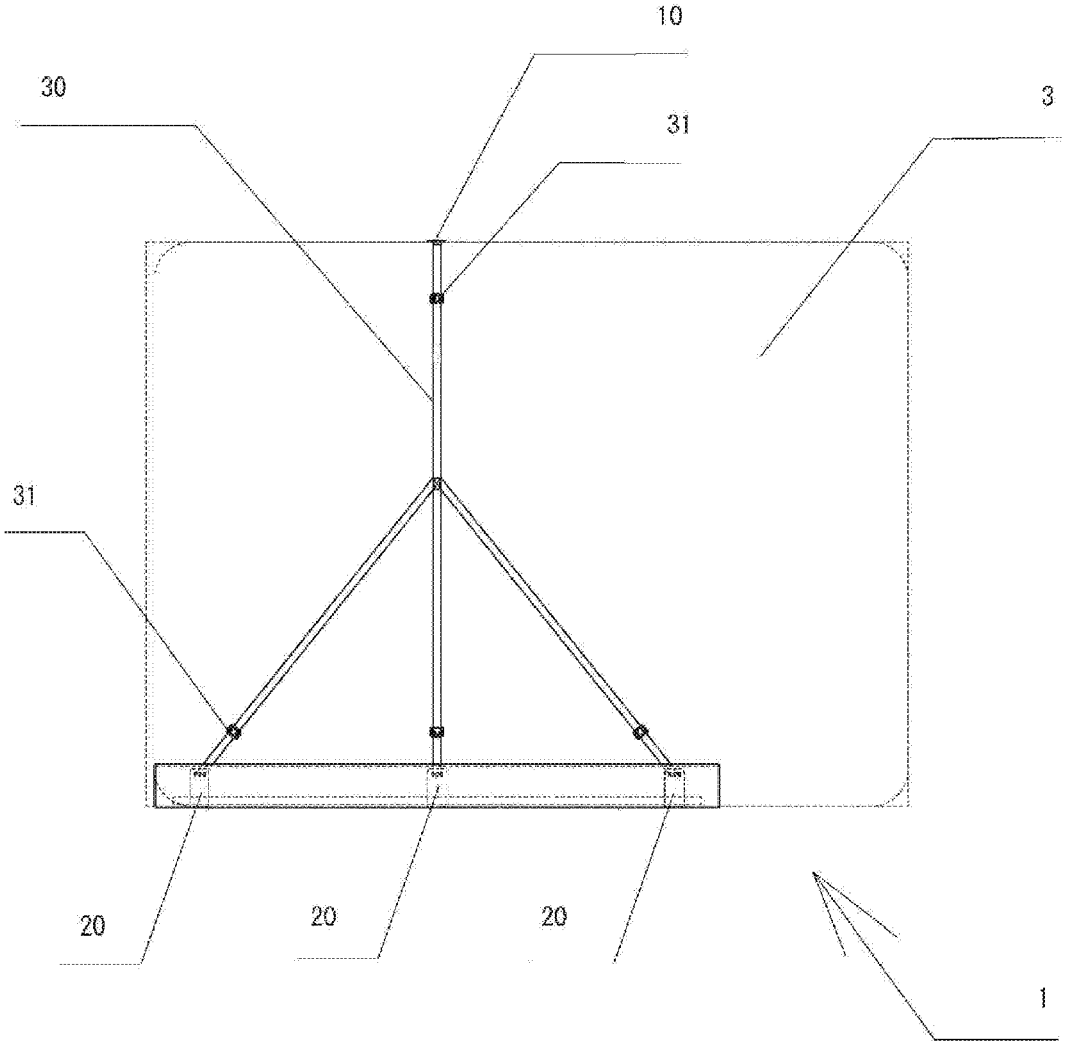
FIG. 7 is a plan bottom view of the of an example embodiment cushion for co-sleeping of FIG. 5.

FIG. 5 is an elevation view indicating an example embodiment. FIG. 6 is a right side view of the same. FIG. 7 is a plan bottom view of the same. As depicted, the cushion for co-sleeping is used in the form as follows: the belt member 30 intermediates between a bottom 2 and a mattress 3 that constructs a bed 1; the latch plate 10 is locked by the mattress 3 and the bottom 2; and the L-shaped plate 20 is supported at the position contacting a side of the mattress 3 opposite to the side of the latch plate 10 locked. Then, the L-shaped plate 20 supports the cushion member 40 placed on the mattress 3.

Figure 2:
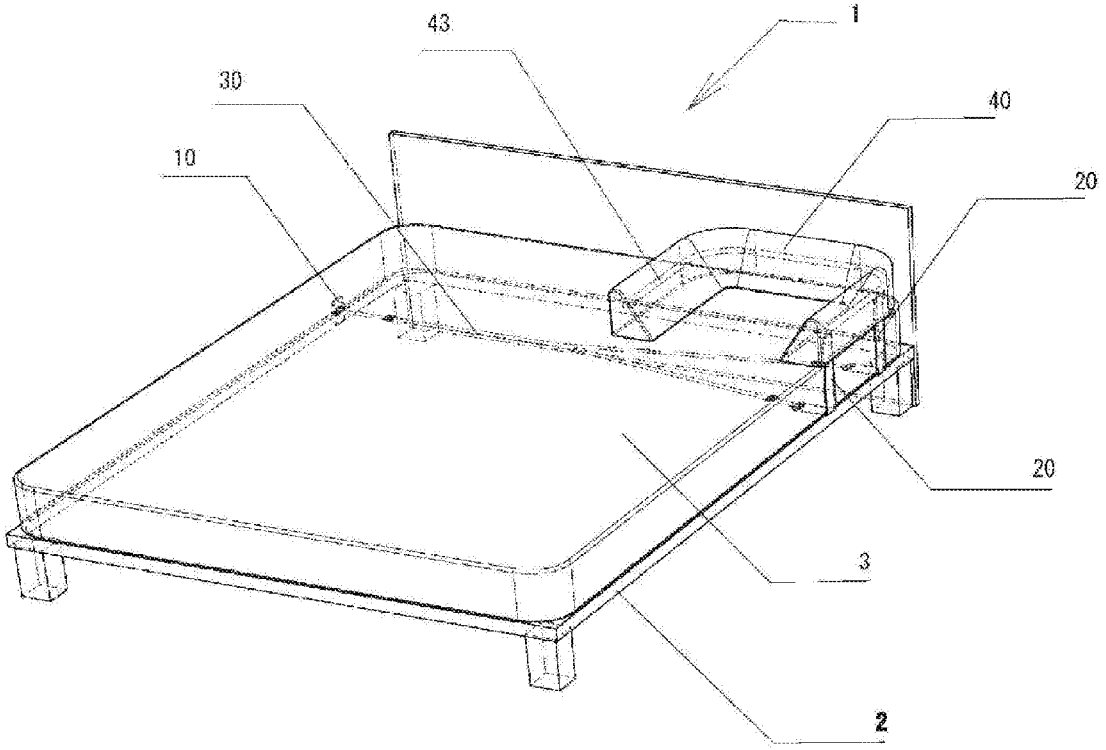
FIG. 2 is a description figure of an example embodiment cushion for co-sleeping.
Figure 3:
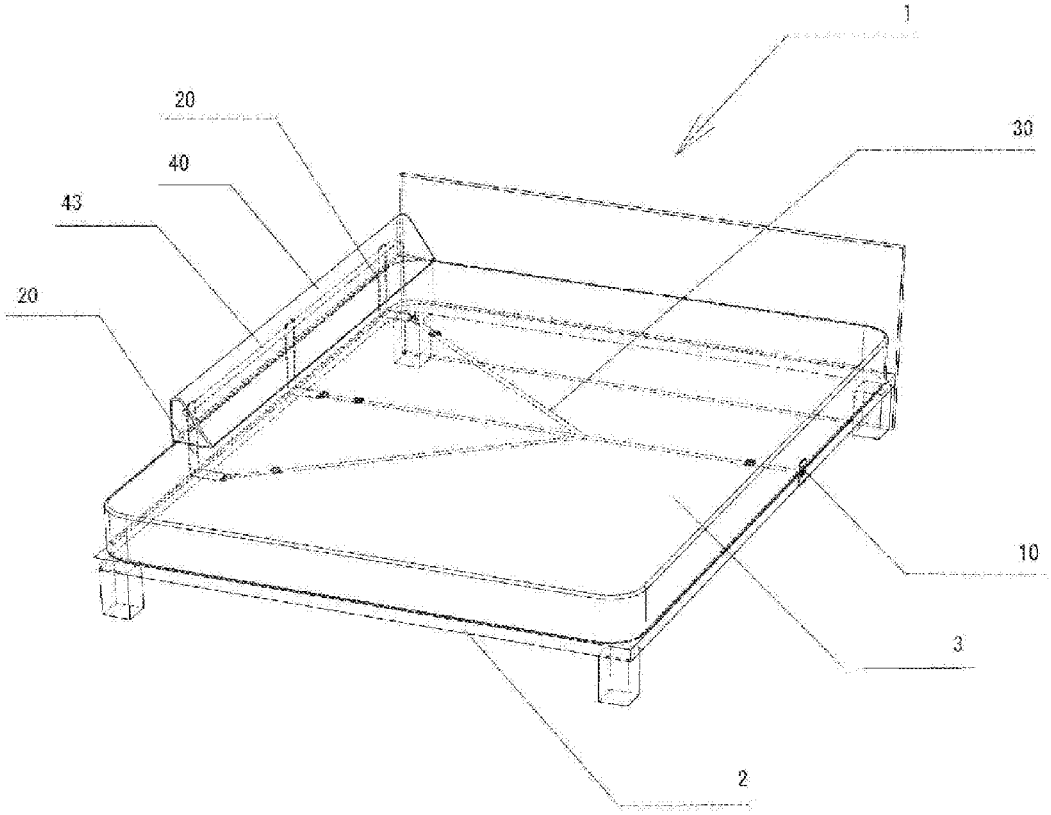
FIG. 3 is a description figure of an example embodiment cushion for co-sleeping.
Figure 4:
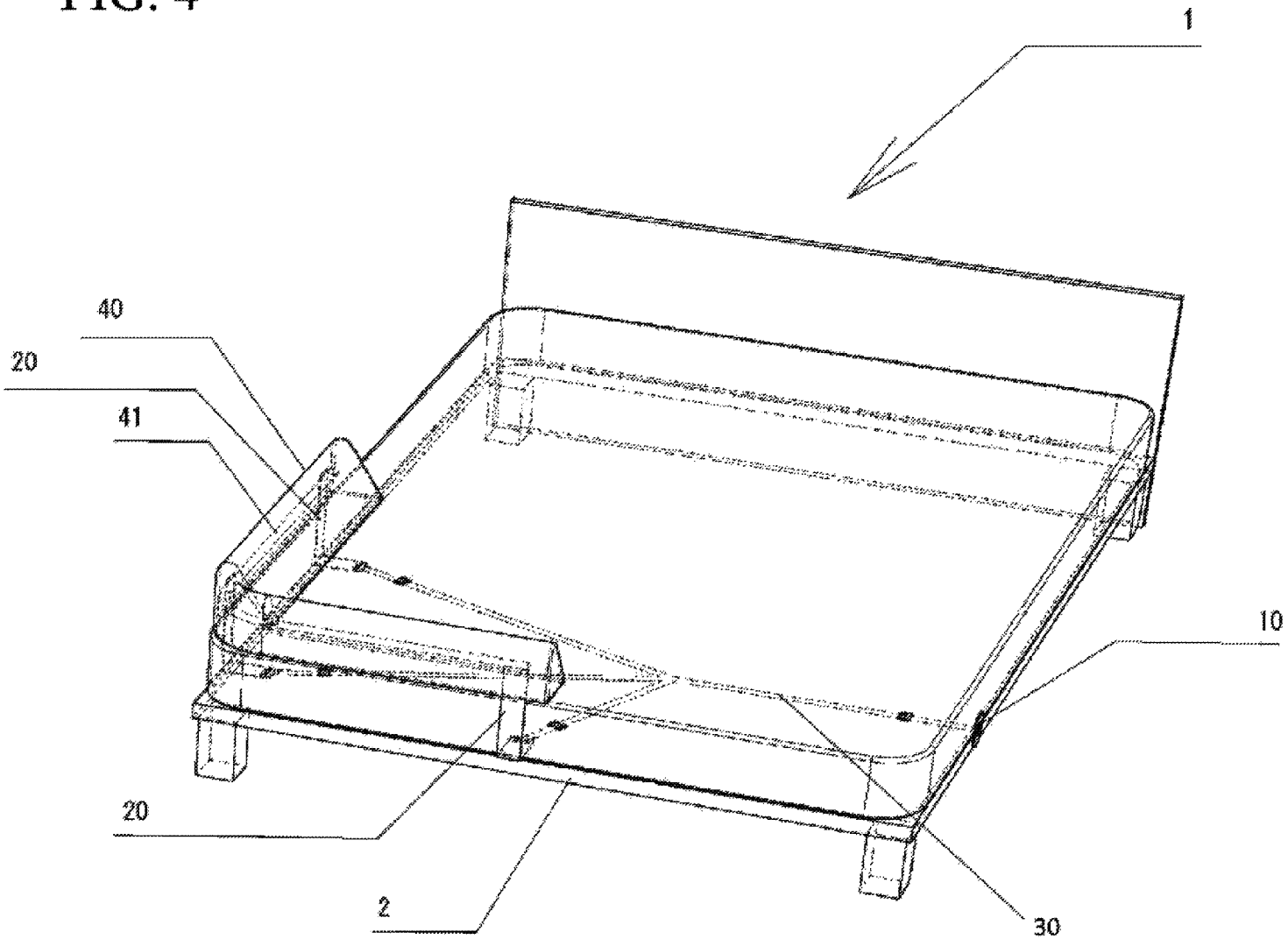
FIG. 4 is a description figure of an example embodiment cushion for co-sleeping.

FIGS. 2-4 are description figures indicating an example embodiment. FIG. 2 indicates a state that the cushion member 40 is bent in the form of U-shape (like the Japanese letter "ko") so that one side of it is supported by L-shaped plate 20. When a baby is put inside the cushion member 40 in the form of U-shape, the cushion member 40 works as a barrier and thus prevents problems that the co-sleeper covers the baby by rolling over and/or the hand of the co-sleeper covers the mouth of the baby.

FIG. 3 depicts a state that the cushion member 40 is formed straightforward and placed on the side of the mattress 3. FIG. 4 depicts a state that the cushion member 40 is bent by 90 degrees and placed on the corner of the mattress 3. Placing the cushion 40 on the mattress 3 in this formation to form a wall makes it possible to prevent a baby from fallout from the bed.

Figure 8A:
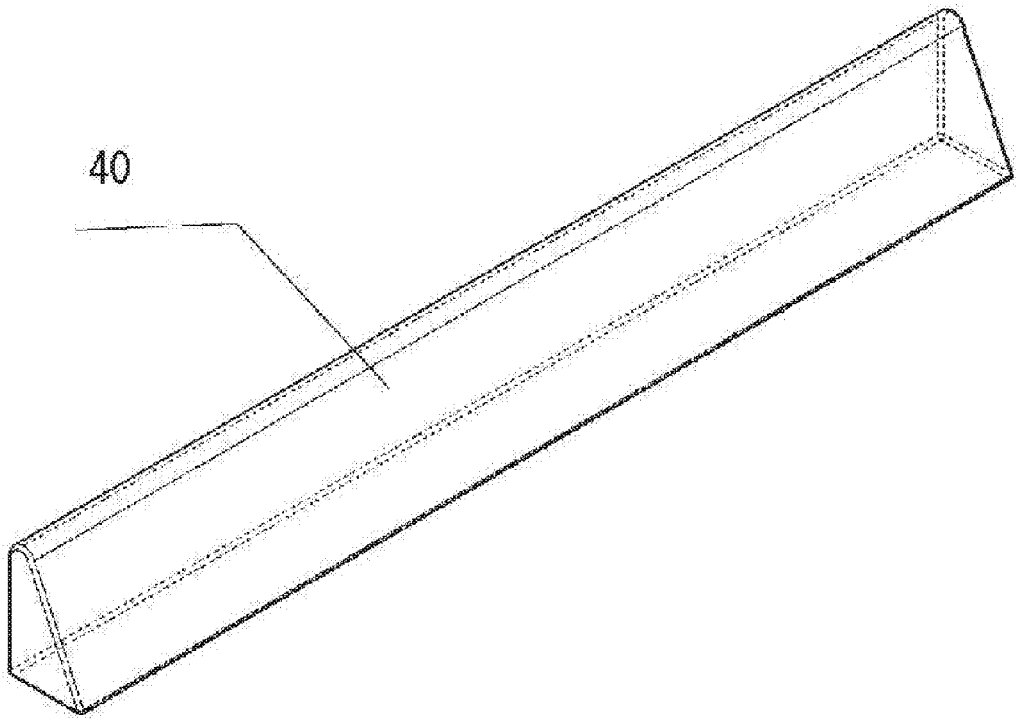
FIG. 8A is an example embodiment cushion in a straight shape.
Figure 8B:
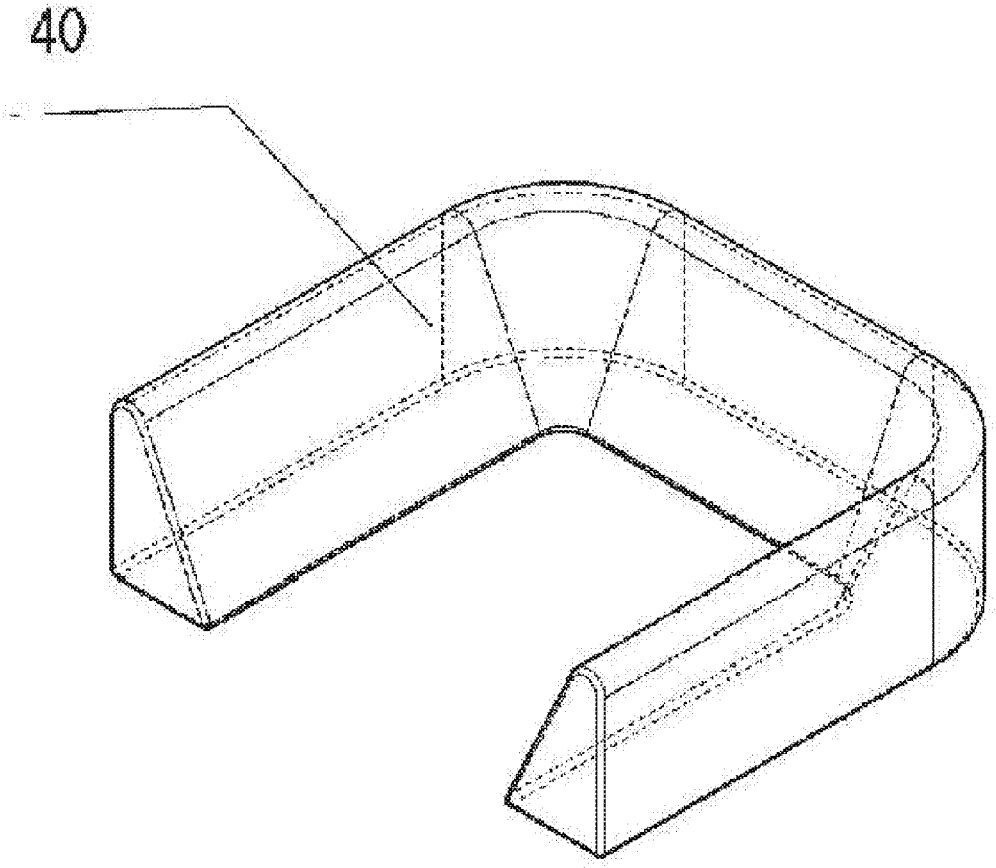
FIG. 8B is an example embodiment cushion in a U-shape.
Figure 8C:
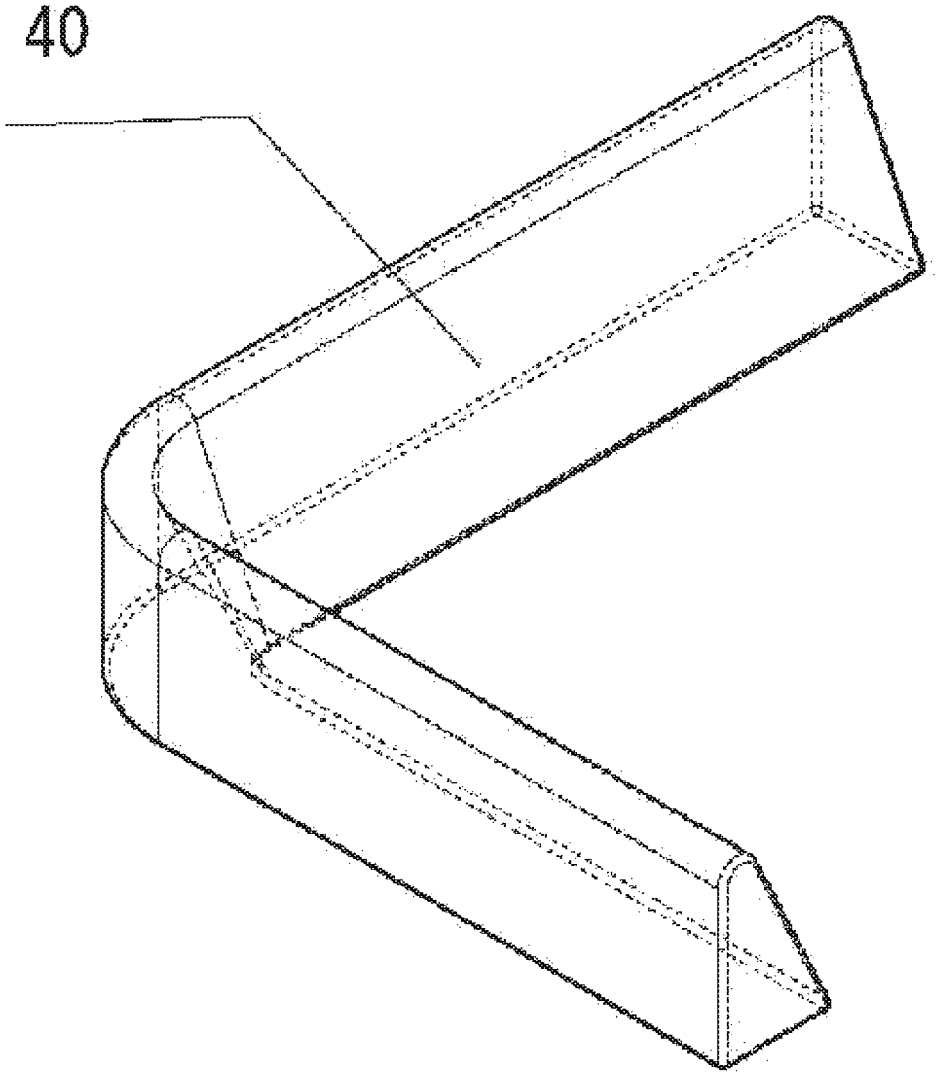
FIG. 8C is an example embodiment cushion bent by 90-degrees.
Figure 8D:
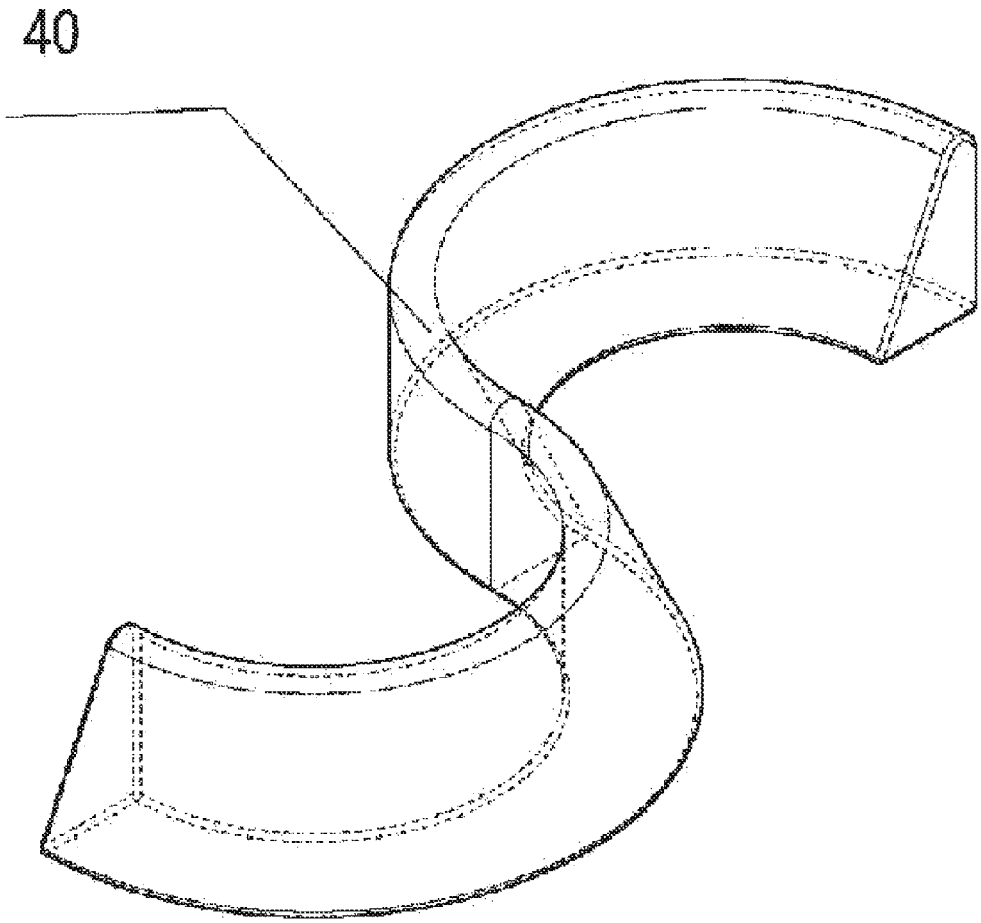
FIG. 8D is an example embodiment cushion in an S-shape.
Figure 8E:
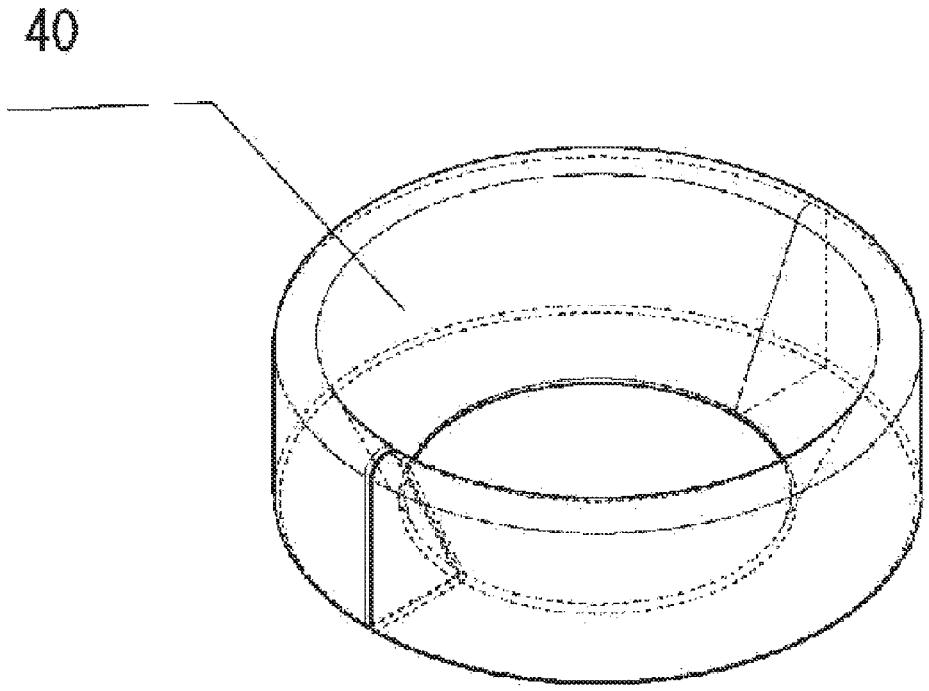
FIG. 8E is an example embodiment cushion in a circular shape.
Figure 8F:
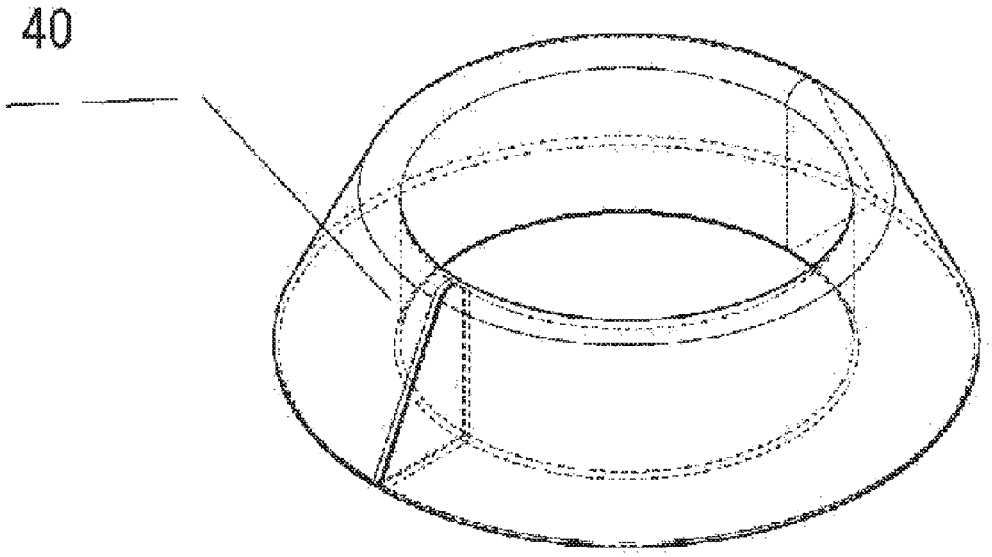
FIG. 8F is an example embodiment cushion in a circular shape.
Figure 9:
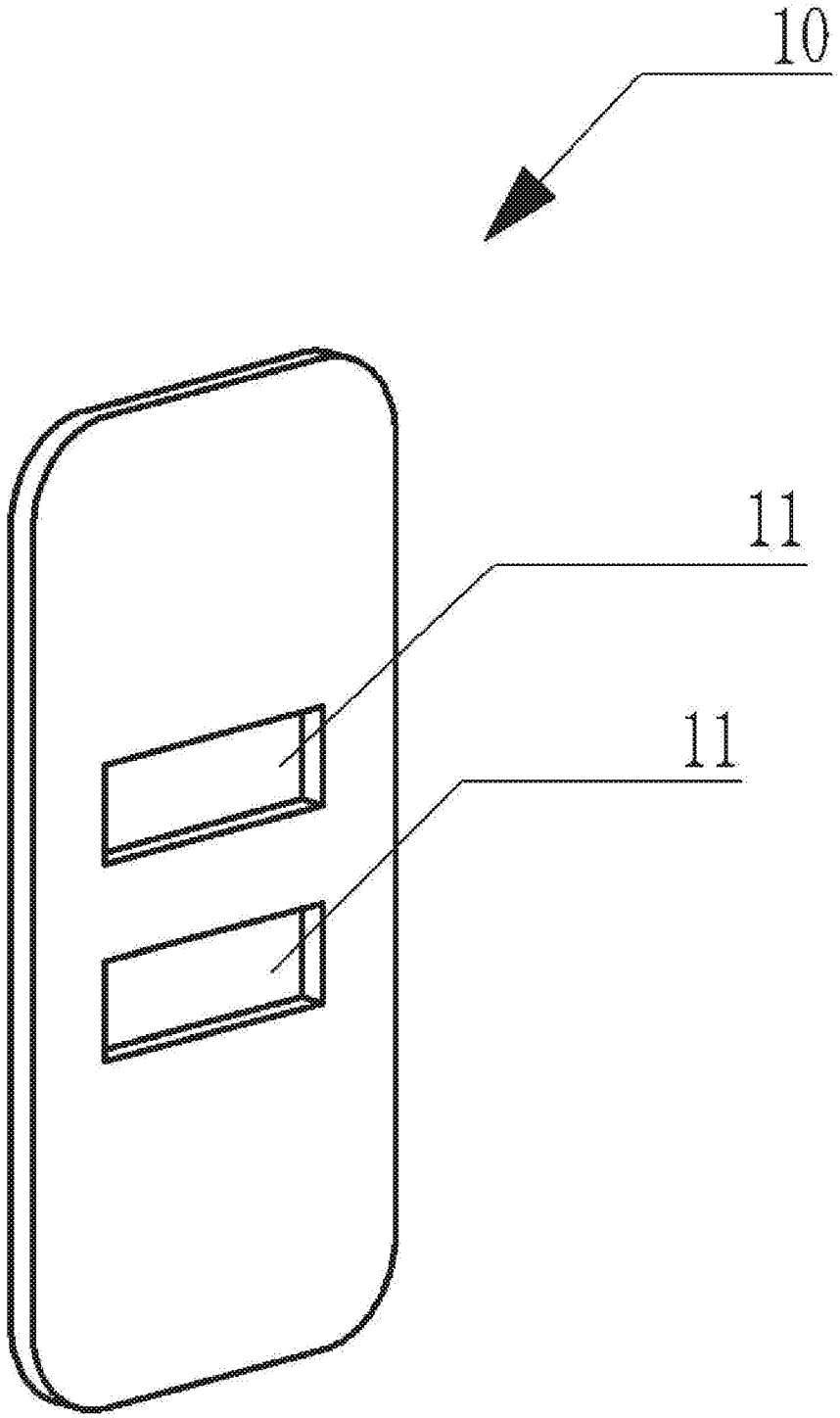
FIG. 9 is a perspective view of an example embodiment latch plate.
Figure 10:
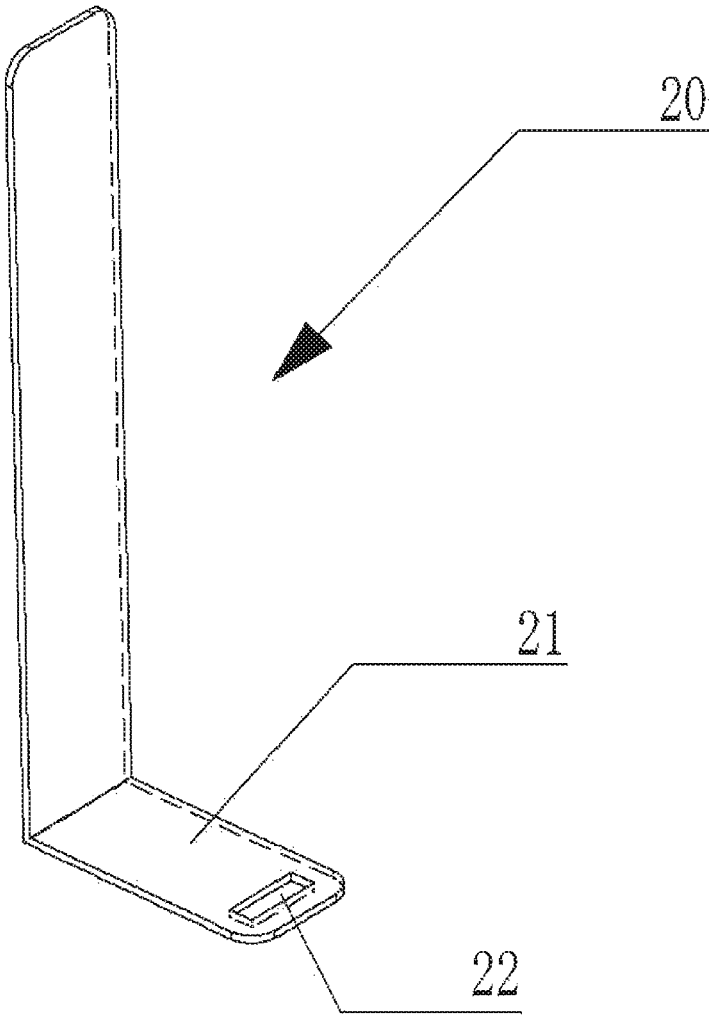
FIG. 10 is a perspective view of an example embodiment L-shaped plate.

Inside the cushion member 40, a bendable pipe 41 is enclosed. Thus, the cushion member 40 may be bent in various forms as shown in FIGS. 8A-8F. Formation in straightforward as shown in FIG. 8A, formation in U-shape as shown in FIG. 8B, formation bent by 90 degrees as shown in FIG. 8C, formation in S-shape as shown in FIG. 8D, formation in a circular shape so that an inclined surface comes to an inner circumference as shown in FIG. 8E, and formation in a circular shape so that an inclined surface comes to an outer circumference as shown in FIG. 8F are possible, allowing usage as a toy or for assistance for sitting-in of the baby.

As described, example embodiments make it possible to provide a space that secures a safe sleeping environment for infants. An example embodiment co-sleeping cushion is mainly comprised of a latch plate 10, an L-shaped plate 20, a belt member 30 and a cushion member 40 as depicted in FIG. 1.

FIG. 5 indicates the latch plate 10 that penetrates the belt member 30 into the center of a planar bar member, having two holes 11 for coupling with the belt member 30.

FIG. 6 depicts an L-shaped plate 20 provided with two holes 22 in which the belt member 30 is inserted into one side portion 21 which is a bar member bent in the form of L-shaped, to couple with the belt member 30. Although three L-shaped members 20 are used in FIG. 1, the embodiment is not limited to this number and one or more members may be used depending on the shape of the cushion 40.

The belt member 30 may be one string body or branched as shown in FIG. 1. At any rate, it may be branched depending on the number of L-shaped member 20 and may be branched depending on the number of latch plate 10 on the side of coupling with the latch plate 10 although not depicted. Further, an adjuster 31 intermediates in the belt member 30 to allow the length of the belt member adjustable according to the width of a mattress.

The cushion member 40 is comprised of a cushion 41, a cushion cover 42 that accommodates the cushion 41, a bendable pipe 43 equipped in the cushion 41.

Figure 13:
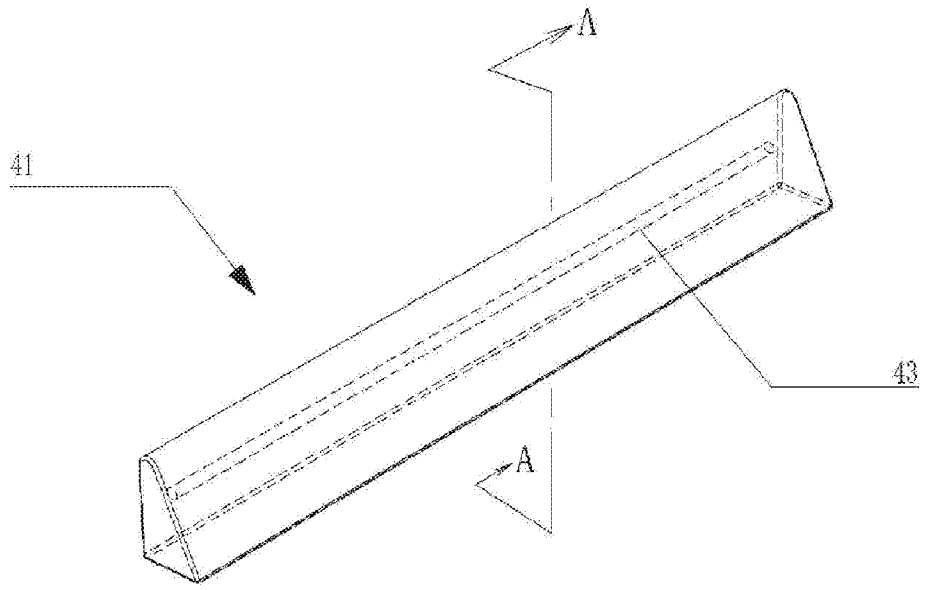
FIG. 13 is a perspective view of an example embodiment cushion cover.
Figure 14:
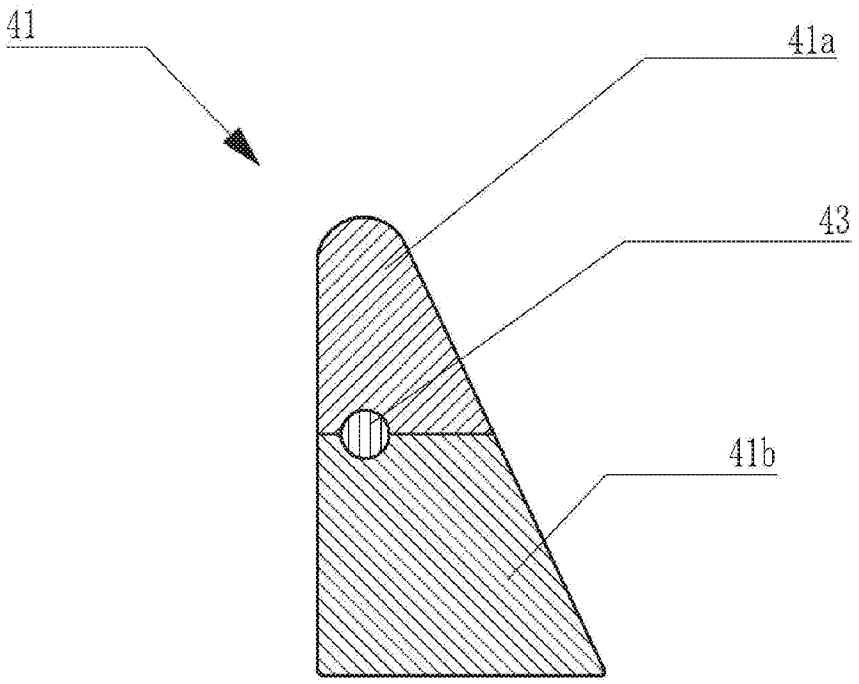
FIG. 14 is a sectional view of A-A line section of the example embodiment cushion cover of FIG. 13.

FIG. 13 is a perspective view of a cushion cover. FIG. 14 is a sectional view of A-A line section. Two members of the cushion 41*a* and the cushion 41*b* are overlaid in an upward/downward direction to form a substantially triangular section as a whole. Then, the bendable pipe 43 intermediates between the cushion 41*a* and the cushion 41*b*. Of course, this is only an example and it is possible to form the cushion as one body and provide a long hole in which the bendable pipe is inserted.

The bendable pipe 43 should be strong enough to maintain the shape of bending when the cushion 41 is bent. For example, the metallic flexible pipe may be used.

Figure 11:
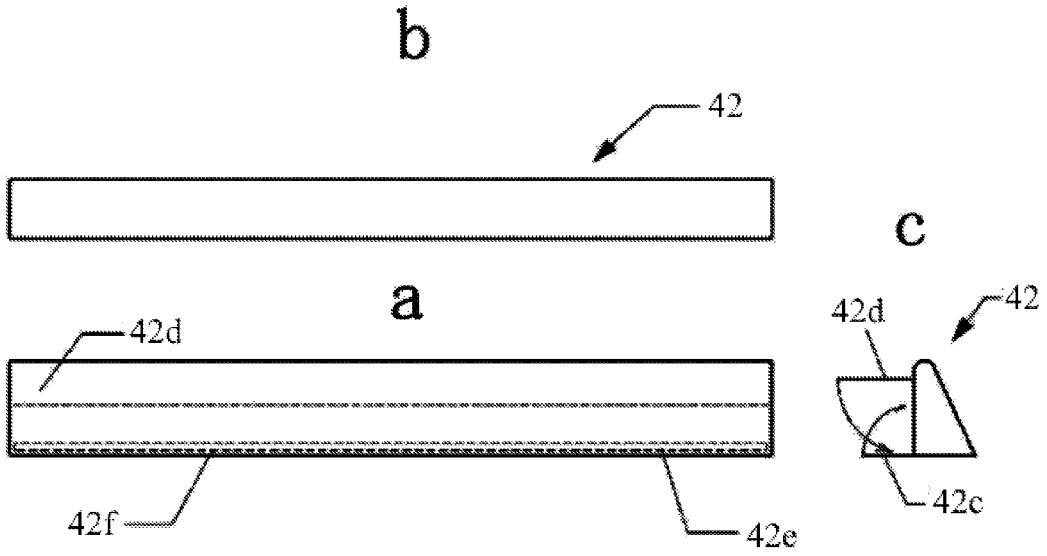
FIG. 11A is an elevation view of an example embodiment cushion cover.
FIG. 11B is a plan top view of an example embodiment cushion cover.
FIG. 11C is a right side view of an example embodiment cushion cover.
Figure 12:
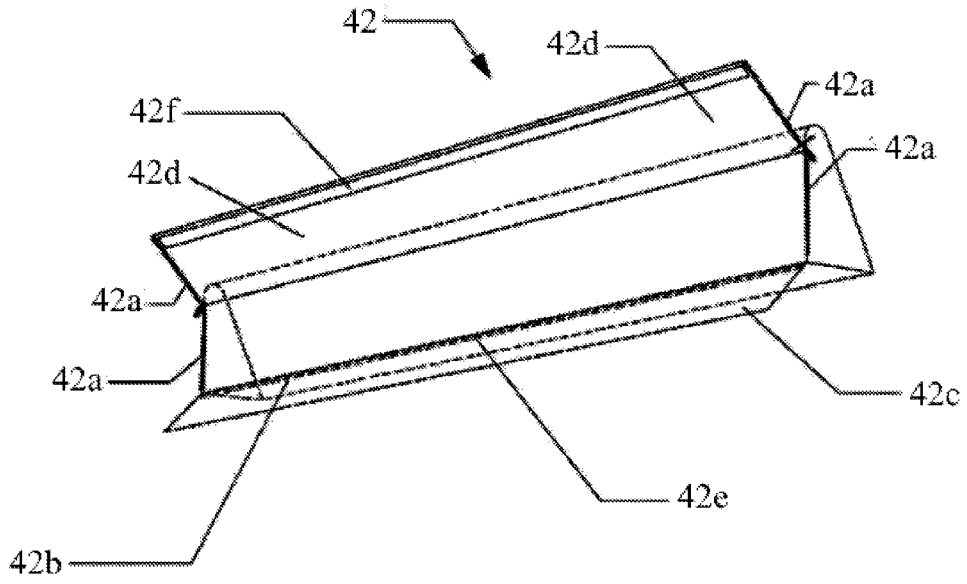
FIG. 12 is a perspective view of an example embodiment cushion cover.

FIGS. 11A-11C depicts elevation views of the cushion cover. FIG. 12 depicts a perspective view of a cushion cover. The cushion cover 42 is formed to be similar to the outline of the cushion 41. One side 42*d* of the cushion cover 42 is formed openable to accommodate the cushion 41 and has fasteners 42*a* on both edges. Meanwhile, bottom sides 42*b* do not have fasters because L-shaped plates 20 should be inserted. A planar fastener 42*e* is provided with a piece of patch 42*c* is extended from the bottom side 42*b* and is used to contact a planar fastener 42*f* provided in the side 42*d*. When using, the cushion 41 is accommodated in the cushion cover 42 and the piece of patch 42*c* is closed. Then, the side 42*d* is put on them and the planar fasteners 42*e* and 42*f* are connected so that the state of closing is maintained and the fastener 42*a* is closed further. At this time, an L-shaped plate 20 is inserted in the space between the piece of patch 42*c* and the side 42*d*.

The method of supporting the cushion member 40 by the L-shaped plate 20 is only one example. As long as the cushion member 40 can be supported, an arbitrary way may be adopted.

Some example embodiments and methods being described here and in the incorporated documents, it will be appreciated by one skilled in the art that example embodiments may be varied through routine experimentation and without further inventive activity. For example, although example embodiments describe a bendable pipe it is understood that any flexible, shape-retaining structures is included within the meaning of such a pipe. Variations are not to be regarded as departure from the spirit and scope of the exemplary embodiments, and all such modifications as would be obvious to one skilled in the art are intended to be included within the scope of the following claims.

What is claimed is:

1. A cushion for co-sleeping comprising:

a planar latch plate;

a belt coupled to the latch plate;

an L-shaped plate coupled to the belt, wherein the L-shaped plate is shaped to seat a first leg of the L-shaped plate under a bottom of a mattress of a bed and a second leg of the L-shaped plate against a side of the mattress;

a cushion shaped to be blocked by the second leg of the L-shaped plate extending beyond the mattress such that the cushion cannot be pushed beyond the second leg and the mattress; and a bendable pipe enclosed in the cushion, wherein bending the cushion also bends the bendable pipe which maintains the cushion in the bent shape.

2. The cushion of claim 1, further comprising:

a plurality of the L-shaped plates.

3. The cushion of claim 2, further comprising:

an adjuster configured to adjust a length of the belt.

4. The cushion of claim 3, wherein the plurality of L-shaped plates is sandwiched by cushion covers to support the cushion.

5. The cushion of claim 1, further comprising:

an adjuster configured to adjust a length of the belt.

6. The cushion of claim 5, wherein the L-shaped plate is sandwiched by cushion covers to support the cushion.

7. The cushion of claim 1, wherein the L-shaped plate is sandwiched by cushion covers to support the cushion.

8. The cushion of claim 1, further comprising:

a plurality of the L-shaped plates, wherein, each of the L-shaped plates couple to the bendable pipe at different positions of the bendable pipe via the leg seating against the side of the mattress, the planar latch plate is shaped to seat against an opposite side of the mattress from at least one of the L-shaped plates, and the belt is configured to join each of the L-shaped plates and planar latch plate by running under the bottom of the mattress.

* * * * *